US006120391A

United States Patent [19]

Moriyama et al.

[11] Patent Number: 6,120,391

[45] Date of Patent: Sep. 19, 2000

[54] THREE PIECE SOLID GOLF BALL

[75] Inventors: Keiji Moriyama; Yoshinori Sano, both of Fukuchiyama; Kazunari Yoshida, Kasai, all of Japan

[73] Assignee: Sumitomo Rubber Industries, Ltd.

[21] Appl. No.: 09/159,678

[22] Filed: Sep. 24, 1998

[30] Foreign Application Priority Data

Oct. 1, 1997 [JP] Japan ..... 9-268598

[51] Int. Cl.[7] ..... A63B 37/12

[52] U.S. Cl. ..... 473/374; 473/377

[58] Field of Search ..... 473/373, 374, 473/377

[56] References Cited

U.S. PATENT DOCUMENTS 4,919,434 4/1990 Saito .
5,439,227 8/1995 Egashira et al. .
5,688,191 11/1997 Cavallaro et al. ..... 473/373

FOREIGN PATENT DOCUMENTS 0637459 2/1995 European Pat. Off. .
2302330 1/1997 United Kingdom .
2302546 1/1997 United Kingdom .
9718861 5/1997 WIPO .

*Primary Examiner*—Steven Wong

[57] ABSTRACT

A three piece solid golf ball with enhanced flight performance and without diminished shot feel at a time of hitting, which includes a core, an intermediate layer formed on the core and a cover covering the intermediate layer. The golf ball, when hit at a head speed of 40 m/sec by a driver equipped with a swing robot, has a maximum impact force of 1,100 to 1,250 kgf and when hit at a head speed of 2.9 m/sec by a putter, has a maximum impact force of 40 to 50 kgf.

11 Claims, 4 Drawing Sheets

THREE PIECE SOLID GOLF BALL

FIELD OF THE INVENTION

The present invention relates to a three piece solid golf ball. Particularly, it relates to a three piece solid golf ball with enhanced flight performance without damaging shot feel when hitting.

BACKGROUND OF THE INVENTION

There are two types of golf balls commercially available, that is solid golf balls (such as two piece solid golf balls and three piece solid golf balls) and thread wound golf balls. Recently, the solid golf balls have been popular in the golf ball market, because they give longer flight distance while maintaining soft shot feel which is equal to the soft shot feel of thread wound golf balls. Especially, the three piece solid golf balls have much variety of hardness distribution in comparison with the two piece solid golf ball and therefore exhibit excellent shot feel without damaging flight performance. However, the excellent shot feel of the three piece solid golf balls is apparent when hit by a driver, i.e. a 1 wood club, but when they are putted, the three piece solid golf balls show hard feel and poor controllability because of high speed separation between the golf ball and the putter.

OBJECT OF THE INVENTION

The present invention is to provide a three piece solid golf ball which has excellent shot feel in both driver shot and putter shot, without deteriorating flight performance.

SUMMARY OF THE INVENTION

The present invention is to provide a three piece solid golf ball which comprises a core, an intermediate layer formed on the core and a cover covering the intermediate layer, wherein the golf ball has a maximum impact force by a driver of 1,100 to 1,250 Kgf and a maximum impact force by a putter of 40 to 50 Kgf.

The golf ball of the present invention is also defined by a compression deformation amount, when applying an initial load of 10 Kgf to a final load of 130 Kgf on the golf ball, and a Shore D hardness of the intermediate layer.

The three piece solid golf ball of the present invention has excellent shot feel at a time of hitting and exhibits excellent flight performance.

DETAILED DESCRIPTION OF THE INVENTION

Figure 2:
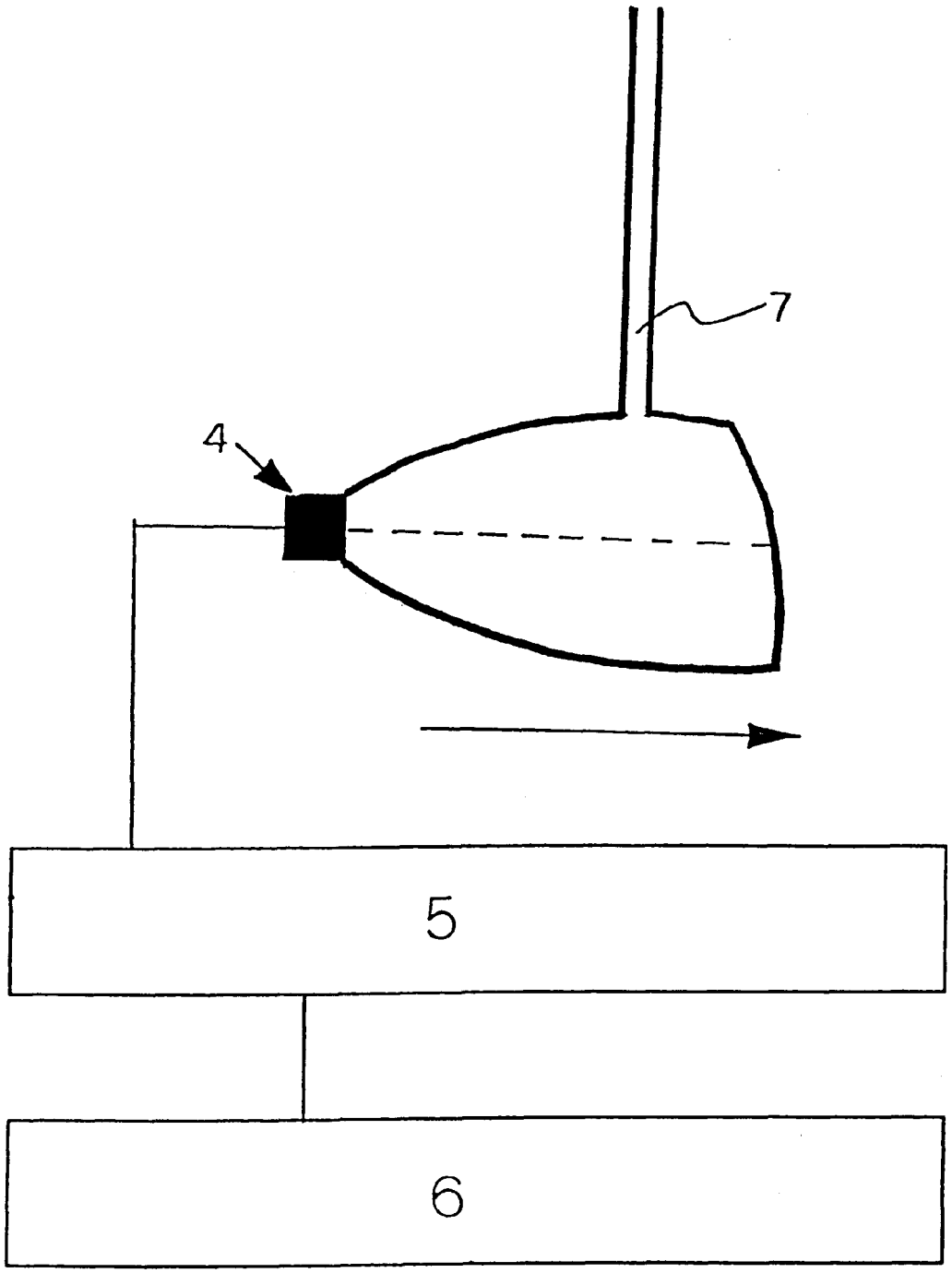
FIG. 2 schematically shows the method for determining impact force by a driver.
Figure 4:
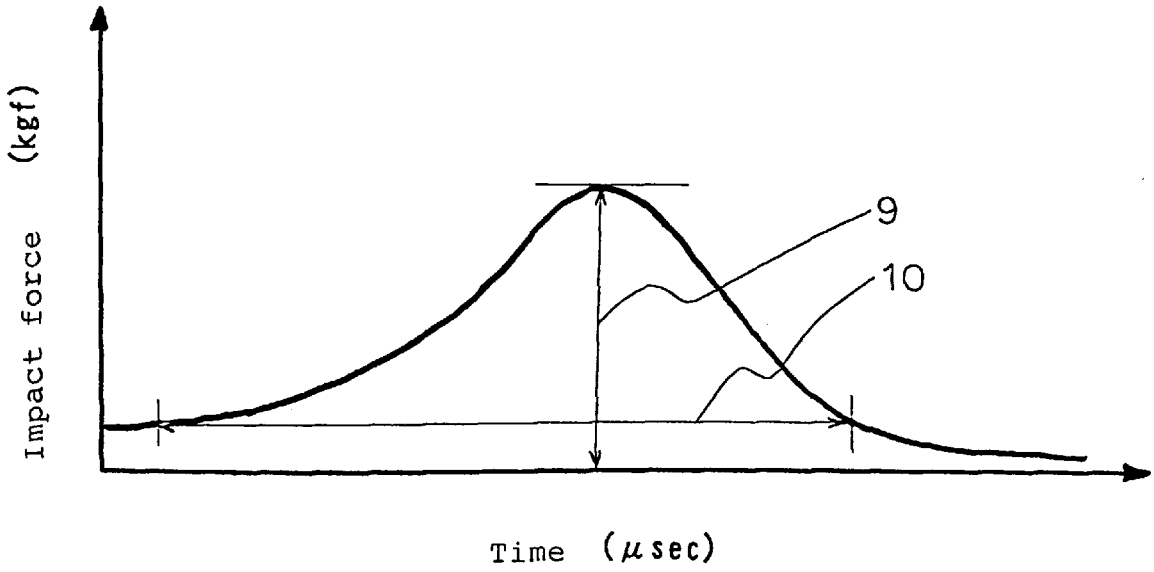
FIG. 4 is a graph showing change of impact force with time, which is obtained in the method for determining impact force.

The three piece solid golf ball of the present invention has a maximum impact force by a driver of 1,100 to 1,250 Kgf, preferably 1,150 to 1,250 Kgf and a maximum impact force by a putter of 40 to 50 Kgf, preferably 45 to 50 Kgf. The term "maximum impact force by a driver" means that, when a golf ball is hit by a driver, i.e. a No. 1 wood club, equipped with a swing robot at a head speed of 40 m/sec, an impact force is measured by an acceleration pick-up equipped with a back portion of the head of the driver, as shown in FIG. 2, and a maximum value is expressed as the maximum impact force. A relation between impact force and time is drawn as a graph, of which an example is shown in FIG. 4. In FIG. 4, the number 9 is the maximum impact force. The details of the measurement will be explained in Examples. If the maximum impact force by a driver is less than 1,100 Kgf, shot feel is too light and one does not feel sufficient impact force. In other words, soft shot feel is not given. If it is more than 1,250 Kgf, shot feel is hard. FIG. 4 also shows a contact time (10), that is, a time from the occurrence of impact force to the extinction of impact force, which means a time when the golf club is contacted with the golf ball. The contact time is preferably 480 to 580 μsec, preferably 480 to 520 μsec. If the contact time is less than 480 μsec, the separation of ball and club is too short and controllability is poor. If it is more than 580 μsec, the golf ball is contacted with the club face too long and one feels heavy when hitting.

Figure 3:
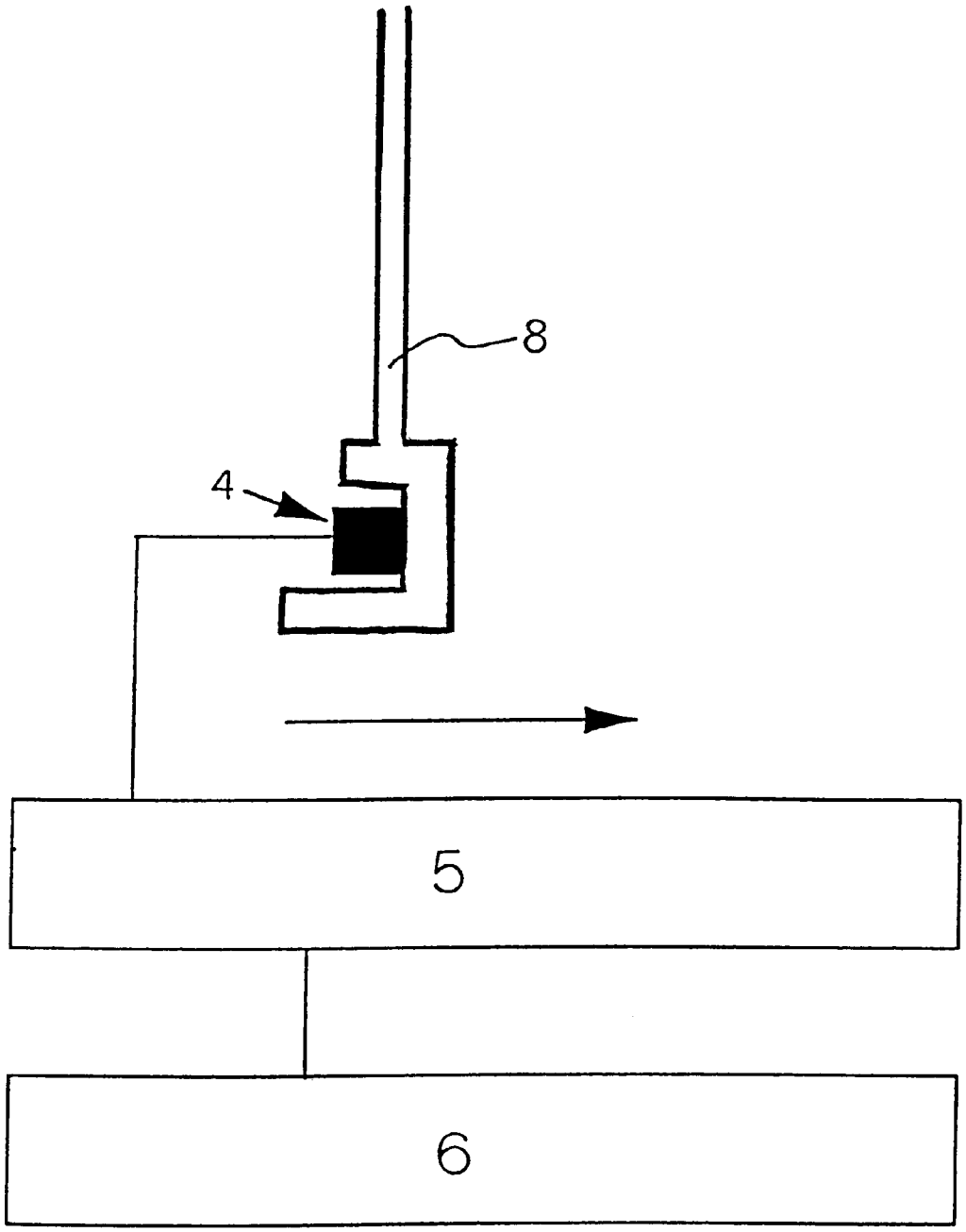
FIG. 3 schematically shows the method for determining impact force by a putter.

The three piece solid golf ball of the present invention has a maximum impact force by a putter of 40 to 50 Kgf. The term "maximum impact force by a putter" means that, when a golf ball is hit by a putter, i.e. a club for putting, equipped with a pendulum type putting machine at an angle of 40° from a position perpendicular to the ground, an impact force is measured by an acceleration pick-up equipped with a back portion of the head of the putter, as shown in FIG. 3, and a maximum value is expressed as the maximum impact force. A relation between impact force and time is drawn as a graph, of which an example is shown in FIG. 4. In FIG. 4, the number 9 is the maximum impact force. The details of the measurement will be explained in Examples. If the maximum impact force by a putter is less than 40 Kgf, shot feel is too light and one does not feel sufficient impact force. If it is more than 50 Kgf, shot feel is hard. FIG. 4 also shows a contact time (10), that is, a time from the occurrence of impact force to the extinction of impact force, which means a time when the golf club is contacted with the golf ball. The contact time for putting is preferably 730 to 830 μsec, preferably 730 to 800 μsec. If the contact time is less than 730 μsec, the separation time of ball and club is too short and controllability is so poor in comparison with thread wound golf balls having very good controllability. If it is more than 830 μsec, the contact time between the ball and the club is long enough to easily hook the ball when putting.

Figure 1:
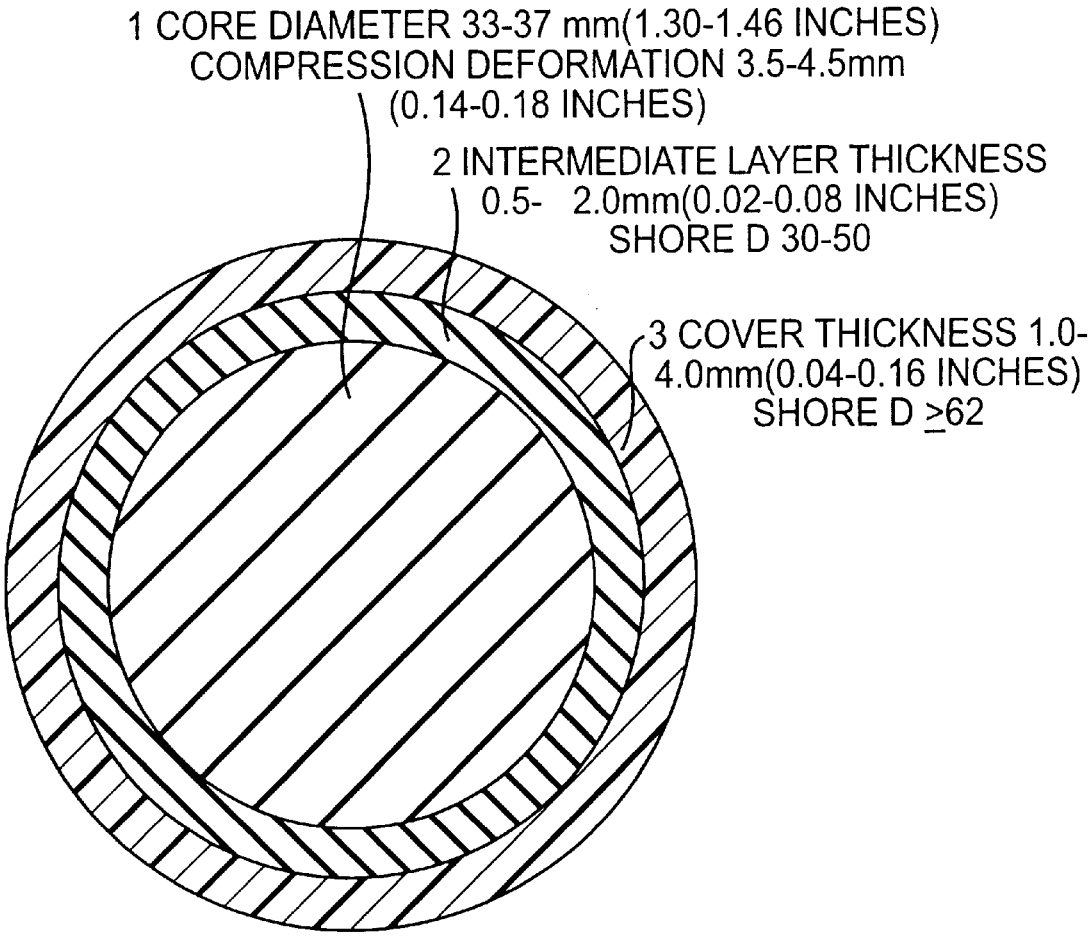
FIG. 1 shows a cross-sectional view of the three piece solid golf ball of the present invention.

The three piece solid golf ball of the present invention will be explained with referring to FIG. 1. FIG. 1 shows a cross-sectional view of the three piece solid golf ball of the present invention. In the three piece solid golf ball of the present invention, an intermediate layer (2) is formed on a core (1) and a cover (3) is formed on the intermediate layer (2).

The core may be formed by vulcanizing a rubber composition which comprises base rubber, metal salt of unsaturated carboxylic acid, organic peroxide, optional additive (such as filler, antioxidant, peptizer) and the like. The base rubber can be anyone that has been used for the core of solid golf balls and include natural rubber and/or synthetic rubber. Preferred base rubber is high-cis-polybutadiene rubber having a cis-1,4-content of not less than 40%, preferably not less than 80%. The high-cis-1,4 -polybutradiene rubber may be combined with other rubber, such as natural rubber, polyisoprene rubber, styrene-butadiene rubber, ethylene-propylenediene rubber (EPDM) and the like.

The metal salt of unsaturated carboxylic acid may be functioned as co-crosslinking agent. Examples of the unsaturated carboxylic acids are unsaturated carboxylic acid having 3 to 8 carbon atoms, such as methacrylic acid and acrylic acid. Examples of the metal ions for forming salt are monovalent metal, such as sodium, potassium and lithium; divalent metal, such as zinc and magnesium; trivalent metal, such as aluminum; and the like. Most preferred is zinc acrylate, because it imparts excellent rebound characteristics to the resulting golf ball. An amount of the metal salt of unsaturated carboxylic acid in the rubber composition may be 15 to 30 parts by weight based on 100 parts by weight of base rubber. Amounts of less than 15 parts by weight harden the rubber and deteriorate shot feel. Those of more than 30 parts by weight deteriorate rebound characteristics and provide poor flight distance.

The organic peroxide is functioned as crosslinking agent or curing agent and can be anyone that has been used for crosslinking rubber composition, including dicumyl peroxide or t-butylperoxide. Preferred is dicumyl peroxide. An amount of the organic peroxide may be 1.0 to 3.0 parts by weight, based on 100 parts by weight of base rubber. Amounts of less than 1.0 part by weight soften the rubber too much and deteriorate flight distance. Those of more than 3.0 parts by weight harden the rubber too much and deteriorate shot feel.

The additive for formulating the rubber composition can be anyone that has been used for the core of solid golf balls and, as mentioned above, include filler, antioxidant, peptizer and the like. Examples of the fillers are inorganic salts, such as zinc oxide, barium sulfate and calcium carbonate; metal powder having high specific gravity, such as tungsten powder and molybdenum powder; a mixture thereof; and the like. An amount of the filler in the rubber composition can be varied based on the specific gravity and size of the core, but preferably is within the range of 5 to 50 parts by weight, based on 100 parts by weight of base rubber. Amounts of less than 5 parts by weight lighten the core and the resulting golf ball too much. Those of more than 50 parts by weight increase the weight of core and ball too much.

The antioxidant and peptizer are known to the art and have been used for the core of golf balls. An amount of the antioxidant may be within the range of 0.2 to 0.5 parts by weight based on 100 parts by weight of base rubber.

The core (1) can be obtained by vulcanizing the above mentioned rubber composition at a temperature of 130 to 180° C. for 10 to 50 minutes in a mold. The core (1) of the present invention preferably has a diameter of 33 to 37 mm, more preferably 34 to 36 mm. Diameters of less than 33 mm increase the spin rate of the golf ball and reduce launch angle when hitting, thus reducing flight distance. Those of more than 37 mm reduce the thickness of the intermediate layer too much and deteriorate shot feel when hitting. The core (1) of the present invention preferably has a compression deformation amount of 3.5 to 4.5 mm, more preferably 3.5 to 4.0 mm, when applying from an initial load of 10 Kgf and to a final load of 130 Kgf on the core. Compression deformation amounts of less than 3.5 mm increase the spin rate of the golf ball and reduce launch angle when hitting, thus reducing flight distance. Those of more than 4.5 mm soften the golf ball and do not obtain enough initial velocity when hitting, thus reducing flight distance.

The intermediate layer (2) of the three piece solid golf ball of the present invention can be formed from any material that has been used for the intermediate layer of the three piece solid golf balls, but may preferably be formed from ionomer resin, thermoplastic elastomer and a mixture thereof. The ionomer resin may be a copolymer of ethylene-(meth)acrylic acid, of which a portion of free carboxylic groups is neutralized with metal ion. The term "(meth) acrylic acid" in this context means either acrylic acid or methacrylic acid, or a mixture thereof. The metal ion for neutralizing the copolymer includes monovalent metal ion, such as Na ion, K ion, Li ion; divalent metal ion, such as Zn ion, Ca ion and Mg ion; and the like. The ionomer resin is generally commercially available and examples thereof are those available from Mitsui Du-Pont Polychemical Co., Ltd. as Hi-Milan 1605 and Hi-Milan 1706; those available from Exxon Co. as IOTEC 7010 and IOTEC 8000; and the like. The thermoplastic elastomer is known in the art as polymer showing rubber resilience at ambient temperature and thermoplasticity at elevated temperature. The thermoplastic elastomer includes polyurethane type thermoplastic elastomer, polyamide type thermoplastic elastomer, polyester type thermoplastic elastomer, styrene-butadiene-styrene block copolymer having epoxy group in the polybutadiene block, terminal OH group-containing thermoplastic elastomer, a mixture thereof and the like. The intermediate layer may contain filler and another additive. Filer includes inorganic salt, such as zinc oxide, barium sulfate and calcium carbonate; metal powder having high specific gravity, such as tungsten powder and molybdenum powder; a mixture thereof; and the like.

The intermediate layer (2) can be formed on the core (1) by a method known for forming a cover of golf balls. The intermediate layer (2) may be formed by molding the resin composition for intermediate layer (2) into spherical half shells and encapsulating the above core (1) within two of the half shells, followed by press-molding at an elevated temperature. The intermediate layer (2) may also be formed by injection-molding on the core (1) to encapsulating the core with the intermediate layer (2).

The intermediate layer (2) of the present invention preferably has a Shore D hardness of 30 to 50, more preferably 30 to 45. If the hardness is less than 30, the golf ball shows reduced initial velocity when hitting and does not obtain sufficient flight distance. If it is more than 50, the golf ball is too hard and shows poor shot feel. If is preferred that the intermediate layer (2) has a thickness of 0.5 to 2.0 mm. If it is less than 0.5 mm, the shot feel is poor and if it is more than 2.0 mm, the initial velocity is too small and the flight distance is not sufficient.

The cover (3) can be formed from any material that has been used for the cover of golf balls, but is mainly formed from an ionomer resin, that is a copolymer of ethylene and (meth)acrylic acid, of which a portion of carboxylic acid groups is neutralized with metal ion. The term "(meth) acrylic acid" in this context means either acrylic acid or methacrylic acid, or a mixture thereof. The metal ion for neutralizing the copolymer includes monovalene metal ion, such as Na ion, K ion, Li ion; divalent metal ion, such as Zn ion, Ca ion and Mg ion; trivalent metal ion, such as Al ion and Nb ion; a mixture thereof; and the like. The ionomer resin is generally commercially available and examples thereof are those available from Mitsui Du-Pont Polychemical Co., Ltd. as Hi-Milan 1557, Hi-Milan 1605, Hi-Milan 1652, Hi-Milan 1705, Hi-Milan 1706, Hi-Milan 1855 and Hi-Milan 1856; those available from Exxon Co. as IOTEC 7010 and IOTEC 8000; and the like.

In the present invention, the cover is formed from a cover resin composition which mainly contains the above mentioned ionomer resin and a small amount of colorant (e.g. titanium dioxide), filler (e.g. barium sulfate), additive and the like. The additive includes dispersant, antioxidant, ultraviolet absorber, light stabilizer, fluorescent agent, fluorescent brightener and the like. Titanium dioxide as colorant is most preferably formulated in the cover composition, but an amount thereof may generally be 0.1 to 0.5 parts by weight based on the 100 parts by weight of the cover resin.

The cover (3) is generally formed on the intermediate layer (2) by the method explained in the formation of the intermediate layer (2). It is preferred that the cover (3) has a thickness of 1.0 to 4.0 mm. Thickness of less than 1.0 mm reduces the initial velocity of the golf ball when hitting and therefore shortens the flight distance. Thickness of more than 4.0 mm hardens the golf ball and deteriorates shot feel when hitting. It is also preferred that the cover (3) has a Shore D hardness of not less than 62, preferably 65 to 72. When forming the cover (3), depressions called "dimples" are formed on the cover surface, if necessary. The golf ball may be further painted or marked to enhance appearance and quality.

The golf ball of the present invention may preferably has a compression deformation amount of 2.8 to 3.2 mm, more preferably 2.9 to 3.1 mm, when applying from an initial load of 10 Kgf and to a final load of 130 Kgf on the core. Compression deformation amounts of less than 2.8 mm deteriorate shot feel, especially in putting, and shorten separation time between club head and golf ball, thus resulting in poor controllability. Those of more than 3.2 mm soften the golf ball and do not obtain enough initial velocity when hitting, thus reducing flight distance.

EXAMPLES

The present invention will be illustrated by the following Examples and Comparative Examples which, however, are not to be construed as limiting the present invention to their details.

Examples 1 to 5 and Comparative Examples 1 to 4

Preparation of core

The rubber compositions for cores, shown in the following Table 1 for Examples and Table 2 for Comparative Examples, were mixed by a roll and pressure-molded at 140° C. for 25 minutes and then at 165° C. for 8 minutes to obtain a core having a diameter of 35.1 mm. The resulting core was subjected to the determination of deformation amount and the results are shown in Table 3 for Examples and Table 4 for Comparative Examples. The deformation amount was conducted as explained in the paragraph of Test Method hereinafter.

Preparation of intermediate layer

The intermediate formulation shown in Table 1 for Examples and Table 2 for Comparative Examples was injection-molded on the core obtained above in a thickness of 1.6 mm to form an intermediate layer. The Shore D hardness of the intermediate layer was determined and the results are shown in Tables 3 and 4.

TABLE 1

| Example Number | 1 | 2 | 3 | 4 | 5 |
|---|---|---|---|---|---|
| (Formulation of core) | | | | | |
| BR 11 *1 | 100 | 100 | 100 | 100 | 100 |
| Zinc acrylate | 25.5 | 25.5 | 25.5 | 25.5 | 24.5 |
| Zinc oxide | 18.9 | 18.9 | 18.9 | 18.9 | 19.2 |
| Antioxidant *2 | 0.5 | 0.5 | 0.5 | 0.5 | 0.5 |
| Dicumyl peroxide | 2.0 | 2.0 | 2.0 | 2.0 | 2.0 |
| Diphenyldisulfide | 0.5 | 0.5 | 0.5 | 0.5 | 0.5 |

TABLE 1-continued

| Example Number | 1 | 2 | 3 | 4 | 5 |
|---|---|---|---|---|---|
| (Formulation of intermediate layer) | | | | | |
| Elastoran ET 880 *3 | 100 | 100 | — | — | 100 |
| Elastoran ET 890 *4 | — | — | 100 | 100 | — |
| Tungsten | 17.7 | 17.7 | 14.4 | 14.4 | 17.7 |
| (Formulation of cover) | | | | | |
| Hi-Milan 1605 *5 | 50 | — | 50 | — | 50 |
| Hi-Milan 1706 *6 | 50 | — | 50 | — | 50 |
| IOTEC 7010 *7 | — | 50 | — | 50 | — |
| IOTEC 8000 *8 | — | 50 | — | 50 | — |

TABLE 2

| Comparative Example Number | 1 | 2 |
|---|---|---|
| (Formulation of core) | | |
| BR 11 *1 | 100 | 100 |
| Zinc acrylate | 27.5 | 27.5 |
| Zinc oxide | 18.3 | 18.3 |
| Antioxidant *2 | 0.5 | 0.5 |
| Dicumyl peroxide | 2.0 | 2.0 |
| Diphenyldisulfide | 0.5 | 0.5 |
| (Formulation of intermediate layer) | | |
| Elastoran ET 880 *3 | 100 | — |
| Elastoran ET 890 *4 | — | 100 |
| Tungsten | 17.7 | 17.7 |
| (Formulation of cover) | | |
| Hi-Milan 1605 *5 | 50 | 50 |
| Hi-Milan 1706 *6 | 50 | 50 |
| IOTEC 7010 *7 | — | — |
| IOTEC 8000 *8 | — | — |

*1 High-cis-polybutadiene rubber available from JSR Co., Ltd.
*2 Yoshinox 425, available from Yoshitomi Pharmaceutical Co., Ltd.
*3 Polyurethane thermoplastic elastomer available from Takeda Bardische Urethane Industries Ltd.
*4 Polyurethane thermoplastic elastomer available from Takeda Bardische Urethane Industries Ltd.
*5 Ionomer resin of ethylene-methacrylic acid, neutralized with sodium ion, available from Mitsui Du-Pont Polychemical Co., Ltd.
*6 Ionomer resin of ethylene-methacrylic acid, neutralized with zinc ion, available from Mitsui Du-Pont Polychemical Co., Ltd.
*7 Ionomer resin of ethylene-acrylic acid, neutralized with zinc ion, available from Exxon Chemical Co.
*8 Ionomer resin of ethylene-acrylic acid, neutralized with sodium ion, available from Exxon Chemical Co.

Preparation of cover

The cover resin composition, shown in Tables 1 and 2, was injection-molded on the intermediate layer and then painted thereon to form a golf ball having a diameter of 42.7 mm. The resulting golf ball was subjected to measurements of compression deformation amount, flight performances (i.e. launch angle, spin amount and flight distance in carry), maximum impact forces by both a driver and a putter, and show feel by both a driver and a putter, and the results are shown in Tables 3 and 4.

In addition, a thread wound golf ball and a two piece solid golf ball, which were both commercially available, were employed and the same tests were conducted, in order to compare the golf balls of the present invention with the commercially available thread wound golf ball and commercially available two piece solid golf ball. The thread wound golf ball is shown as Comparative Example 3 and the two piece solid golf ball is shown as Comparative Example 4.

The test methods are explained as follow.

(Test Method)

(1) Compression Deformation Amount of Both Core and Golf Ball

A deformation amount was determined when applying an initial load of 10 Kgf to a final load of 130 Kgf on a core or a golf ball. The result is shown in the unit of millimeter (mm).

(2) Flight Performance

A driver, i.e. No. 1 wood club available from Sumitomo Rubber Industries, Ltd. as tradename of Tangent Ti 270 having a loft angle of 12.5° and a shaft hardness of R, was equipped with a swing robot available from True Temper Co. and a golf ball was hit thereby at a head speed of 40 m/sec. Its launch angle, spin amount and flight distance in carry (a distance from the hitting point to the point firstly reaching the ground) were determined.

(3) Impact Force

A return of a club head at the time of impact between the club head and a golf ball was measured as acceleration by an acceleration pick-up attached to the opposite side of the club face. An impact force, that is a force for returning the club head, was calculated from the following equation:

$$F(\text{Force})=m(\text{Head Weight})\times a(\text{Acceleration})$$

The acceleration pick-up was Acceler type 4374 available from Brueel & Kjaer Co. The golf clubs employed are a driver and a putter. The driver was DP-901 available from Sumitomo Rubber Industries, Ltd., which had been modified for measuring impact force. The putter was MAXFLI TM-8 available from Sumitomo Rubber Industries, Ltd., which had been modified for measuring impact force. The acceleration pick-up (4), as schematically shown in FIGS. 2 and 3, was attached to the golf club (7 and 8) perpendicular to the axis of a club shaft and at a position deadly opposite to an impact point (i.e. a club face center). After hitting the golf ball, an acceleration was read by a charge amplifier (5) and a change of impact force with time was obtained from a digital oscilloscope (6) as shown in FIG. 4. A peak point of the curb of the acceleration is a maximum impact force (9) and a time between the start point raising the curb and the returning point to the constant value is a contact time (10), that is a time when the club face is contacted with the golf ball. The charge amplifier (5) was a charge amplifier type 2635 manufactured by Brueel & Kjaer Co and the digital oscilloscope (6) was a DS 6612 manufactured by IWATSU Co., Ltd.

(i) When the driver was employed, the golf ball was hit by a driver equipped with a swing robot available from True Temper Co. at a head speed of 40 m/sec.

(ii) When the putter was employed, the golf ball was putted with a putter equipped with a pendulum putter machine swinging from the position at an angle of 40° from a position perpendicular to the ground. The swing of the putter created a head speed of 2.9 m/sec at the position of the contact.

(4) Shot Feel

Ten professional golfers actually hit the golf balls by both a driver and a putter and evaluated. The criteria of the evaluation was as follow.

Criteria of Evaluation

G (Good)—At least 7 golfers answered that shot feel was soft and easy controllable.

F (Fairly good)—At least 7 golfers answered normal shot feel.

P (Poor)—At least 7 golfers answered hard shot feel.

(Test Results)

TABLE 3

| Example number | 1 | 2 | 3 | 4 | 5 |
|---|---|---|---|---|---|
| (Core) Compression deformation amount (mm) | 3.72 | 3.72 | 3.72 | 3.72 | 3.91 |
| (Intermediate layer) Shore D hardness | 33 | 33 | 37 | 37 | 33 |
| (Cover) Shore D hardness | 70 | 71 | 70 | 71 | 70 |
| (Golf ball) | | | | | |
| Compression deformation amount (mm) | 3.04 | 3.03 | 2.98 | 2.88 | 3.15 |
| Launch angle (°) | 12.7 | 12.65 | 12.7 | 12.68 | 12.67 |
| Spin amount | 2675 | 2620 | 2610 | 2710 | 2590 |
| Flight distance in carry (yards) | 202.5 | 202.6 | 202.5 | 202.8 | 201.5 |
| Maximum impact force by driver (Kgf) | 1175 | 1188 | 1188 | 1225 | 1125 |
| Contact time by driver (μsec) | 513 | 493 | 486 | 506 | 520 |
| Maximum impact force by putter (Kgf) | 45 | 47 | 49 | 50 | 42 |
| Contact time by putter (μsec) | 792 | 774 | 746 | 738 | 820 |
| Shot feel by driver | G | G | G | G | G |
| Shot feel by putter | G | G | G | G | G |

TABLE 4

| Comparative Example number | 1 | 2 | 3* | 4** |
|---|---|---|---|---|
| (Core) Compression deformation amount (mm) | 3.32 | 3.32 | | |
| (Intermediate layer) Shore D hardness | 33 | 37 | | |
| (Cover) Shore D hardness | 70 | 70 | | |
| (Golf ball) | | | | |
| Compression deformation amount (mm) | 2.72 | 2.71 | — | — |
| Launch angle (°) | 12.6 | 12.63 | 12.26 | 12.7 |
| Spin amount | 2790 | 2810 | 2980 | 2760 |
| Flight distance in carry (yards) | 199.1 | 198.6 | 197.8 | 201.5 |
| Maximum impact force by driver (Kgf) | 1290 | 1205 | 1120 | 1299 |
| Contact time by driver (μsec) | 468 | 460 | 558 | 471 |
| Maximum impact force by putter (Kgf) | 51 | 53 | 47 | 53 |
| Contact time by putter (μsec) | 721 | 713 | 820 | 724 |
| Shot feel by driver | F | F | G | F |
| Shot feel by putter | F | P | G | P |

*A thread wound golf ball commercially available.
**A two piece solid golf ball commercially available.

As is apparent from the above results, the three piece solid golf balls of Examples 1 to 5 exhibit excellent shot feel not only by a driver but also by putter a, similar to the commercially available thread wound golf ball of Comparative Example 3. They also exhibit better launch angle, better spin amount and longer flight distance than the commercially available two piece solid golf ball of Comparative Example 4. The golf ball of Comparative Example 1 has larger maximum impact force by both a driver and a putter and also has smaller compression deformation amount of core and ball than the present invention. The golf ball of Comparative Example I thus exhibits poor shot feel by both a driver and a putter and has poor flight performance. The golf ball of Comparative Example 2 has larger maximum impact force by a putter and also has smaller compression deformation amount of core and ball than the present invention. The golf ball of Comparative Example 1 thus exhibits poor shot feel by both a driver and a putter and has poor flight performance.

What is claimed is:

1. A three piece solid golf ball comprising a core, an intermediate layer formed on the core and a cover covering the intermediate layer, wherein the golf ball has a maximum impact force by a driver of 1,100 to 1,250 Kgf and a maximum impact force by a putter of 40 to 50 Kgf;

the core has a diameter of 33–37 mm and a compression deformation amount of 3.5–4.5 mm;

the intermediate layer has Shore D hardness of 30–50 (JIS C 50–76); and the cover has shore D hardness of not less than 62 (JIS C 91).

2. The three piece solid golf ball according to claim 1 wherein the golf ball has a contact time by a driver of 480 to 580 $\mu$sec.

3. The three piece solid golf ball according to claim 1 wherein the golf ball has a contact time by a putter of 730 to 830 $\mu$sec.

4. The three piece solid golf ball according to claim 1 wherein the core is formed from a rubber composition which comprises base rubber, metal salt of unsaturated carboxylic acid and organic peroxide.

5. The three piece solid golf ball according to claim 4 wherein the base rubber is high-cis-polybutadiene rubber having a cis-1,4-content of not less than 40%.

6. The three piece solid golf ball according to claim 4 wherein the metal salt of unsaturated carboxylic acid is zinc acrylate.

7. The three piece solid golf ball according to claim 1 wherein the intermediate layer is formed from ionomer resin, thermoplastic elastomer or a mixture thereof.

8. The three piece solid golf ball according to claim 1 wherein the intermediate layer has a thickness of 0.5 to 2.0 mm.

9. The three piece solid golf ball according to claim 1 wherein the cover is formed from an ionomer resin.

10. The three piece solid golf ball according to claim 1 wherein the cover has a thickness of 1.0 to 4.0 mm.

11. The three piece solid golf ball according to claim 1 wherein the golf ball has a compression deformation amount of 2.8 to 3.2 mm.

* * * * *